US005490198A

United States Patent [19]

Gerling

[11] Patent Number: 5,490,198

[45] Date of Patent: Feb. 6, 1996

[54] DEVICE FOR DRIVING A ROTARY ANODE

[75] Inventor: Dieter Gerling, Aachen, Germany

[73] Assignee: U.S. Philips Corporation, New York, N.Y.

[21] Appl. No.: 425,305

[22] Filed: Apr. 17, 1995

Related U.S. Application Data

[63] Continuation of Ser. No. 190,408, Feb. 2, 1994.

[30] Foreign Application Priority Data

Feb. 17, 1993 [DE] Germany ..... 43 04 760.2

[51] Int. Cl.[6] ..... H01J 35/10

[52] U.S. Cl. ..... 378/131; 378/93

[58] Field of Search ..... 378/131, 93

[56] References Cited

U.S. PATENT DOCUMENTS 4,107,535 8/1978 Kotabe et al. .

4,188,559 2/1980 Carville et al. ..... 313/60

4,247,776 1/1981 Seifert ..... 378/93

4,468,800 8/1984 Friedel et al. ..... 378/131

5,060,252 10/1991 Vogler et al. ..... 378/93

FOREIGN PATENT DOCUMENTS 2484698 12/1981 France .

*Primary Examiner*—Craig E. Church

*Attorney, Agent, or Firm*—Edward Blocker

[57] ABSTRACT

The invention relates to a device for driving the rotary anode of an X-ray tube, which device comprises a drive motor (5) having a stator (5*a*) and a rotor (5*b*), which are operated at anode potential, a rotor shaft (6) driving the rotary anode (7), the rotor (5*b*) of the drive motor (5) being constructed as an external rotor and the motor (5) being powered by means of a potential-isolating transmission means.

4 Claims, 3 Drawing Sheets

DEVICE FOR DRIVING A ROTARY ANODE

This is a continuation of application Ser. No. 08/190,408, filed Feb. 2, 1994.

The invention relates to a device for driving a rotary anode of an X-ray tube, which device comprises a drive motor having a stator and a rotor, which are operated at anode potential, a rotor shaft driving the rotary anode.

From U.S. Pat. No. 4,188,559 it is known to drive the rotary anode of an X-ray tube by means of a motor having an internal rotor, the entire motor being at anode potential. As a result of this construction only a small gap is necessary between the rotor and the stator. However, altogether the construction is comparatively bulky because an external stator is used.

It is an object of the invention to provide a device of the type defined in the opening paragraph, which can be of a less expensive and more compact construction.

According to the invention said object is achieved in that the rotor of the drive motor is constructed as an external rotor and the motor is powered by means of a potential-isolating transmission means.

Since the motor is energized via a potential-isolating means a smaller gap between the stator and rotor is needed than in the case that this gap should also provide a potential isolation of several kV. This smaller gap enables a more compact construction to be obtained for the motor.

A substantial further reduction of the motor volume can be achieved in that the rotor is constructed as an external rotor. Since the motor torque is primarily determined by the diameter the overall volume of the motor for a specific rated torque is determined by the motor parts disposed outside the bore area. A stator disposed outside the bore area is substantially more bulky than a rotor disposed outside the bore area, particularly if in accordance with the invention the rotor comprises one or more concentric metal cylinders.

In addition, the external rotor has the advantage of a higher mass moment of inertia in comparison with an internal rotor, so that in the case of disturbances in the electronic circuitry by which the motor is energized, for example as a result of the strong electromagnetic fields which are typical of X-ray tubes, smaller speed fluctuations will occur. A speed control can then be dispensed with or can be of simpler construction.

As a result of the external rotor the electromagnetic field of the motor is shielded more effectively from the electron and X-ray beam than in the case of an external stator. This is of particular advantage if, in accordance with a further embodiment of the invention, the rotor length is greater than the length of the lamination assembly of the stator but smaller than the overall length of the stator. In addition, this rotor arrangement provides a higher torque.

In a further embodiment of the invention the rotor cylinder is made of copper. As a result of the small gap between the stator and the rotor owing to the energization at anode potential the external rotor has such small dimensions that the rotor, which is constructed as a copper cylinder, has no stability problems at higher speeds (for example between 3000 r.p.m. and 20,000 r.p.m.). However, it is also possible to assemble the rotor from two concentric metal cylinders, the copper cylinder being surrounded with an iron cylinder at its side which is remote from the gap. In spite of the different expansion of the two materials owing to thermal expansion and rotational expansion the two rotor layers may be interconnected because the copper inner cylinder expands more strongly than the iron outer cylinder. This connection between the two cylinders results in a higher torque and lower losses. However, such a connection between the two metal cylinders is not possible in the case of internal rotors owing to the different expansion. The motor characteristics of motors with internal rotors are then worse.

The construction described above makes it possible to realise a rotary-anode drive having a power factor of 0.4 to 0.5 and an efficiency of 40% to 60%. This enables the power supply of the motor and the cooling means for the X-ray tube to be simplified considerably.

In a further embodiment of the invention the drive motor is powered via an isolating transformer arrangement or via a potential-isolating DC/DC converter. Potential isolation by means of an isolating transformer arrangement or a potential-isolating DC/DC converter guarantees a correct drive of the drive motor. This requires some volume for the isolating transformer and the DC/DC converter. However, the physical separation between the motor and the potential- isolating means results in a smaller overall volume and enables this overall volume to be divided more effectively within an apparatus.

In a further embodiment of the invention vacuum separation between the rotor and the stator is provided by a non-magnetic separation layer, which aim supports the stator lamination assembly, the separation layer consisting, for example, of nickel chrome steel, a ceramic or glass.

The invention will now be described in more detail with reference to the drawings. In the drawings.

Figure 1:
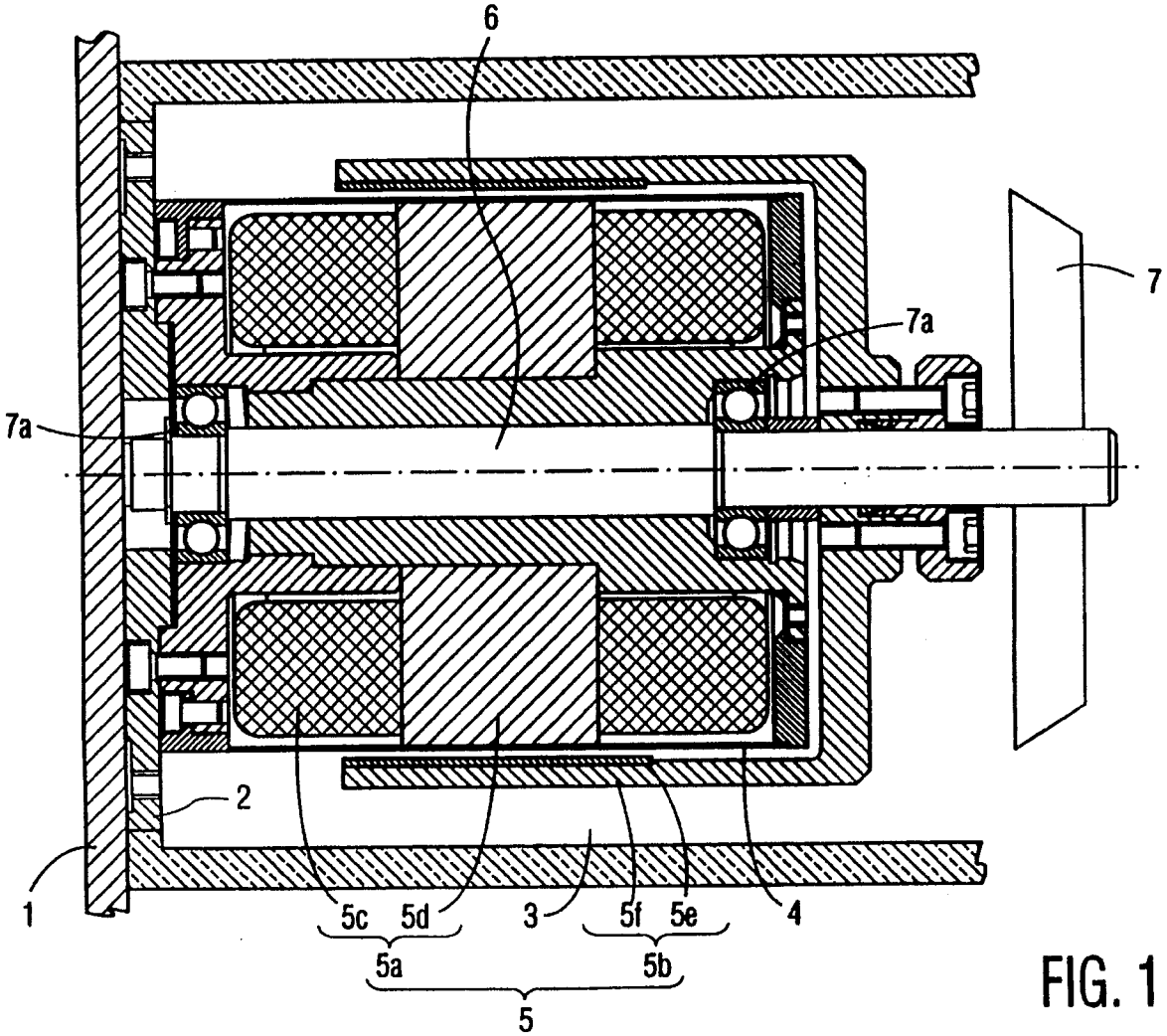
FIG. 1 shows a device for driving a rotary anode of an X-ray tube.

FIG. 1 shows a part of an X-ray tube with a tube part 1, which is at earth potential, an insulator 2 and a vacuum chamber 3. The rotor 5*b* of the drive motor 5 is situated inside the vacuum chamber 3. A separation layer 4 of, for example, CrNi steel, a ceramic or glass in the gap of the motor 5 provides the separation with respect to the vacuum chamber 3. This separation layer 4 also serves to accommodate the stator lamination assembly 5*d*. Grooves in this stator lamination assembly 5*d* accommodate the stator winding 5*c*. The stator winding 5*c* and the stator lamination assembly 5*d* form the stator 5*a* of the drive motor 5. The rotor 5*b* consists of two different materials, i.e. a copper cylinder 5*e* and an iron cylinder 5*f* surrounding the latter. The drive motor 5 drives the rotary anode 7 via a shaft 6. The bearing means 7*a* of the shaft 6 comprise a ball bearing but this may alternatively be a plain bearing or a spiral-groove bearing.

Figure 2:
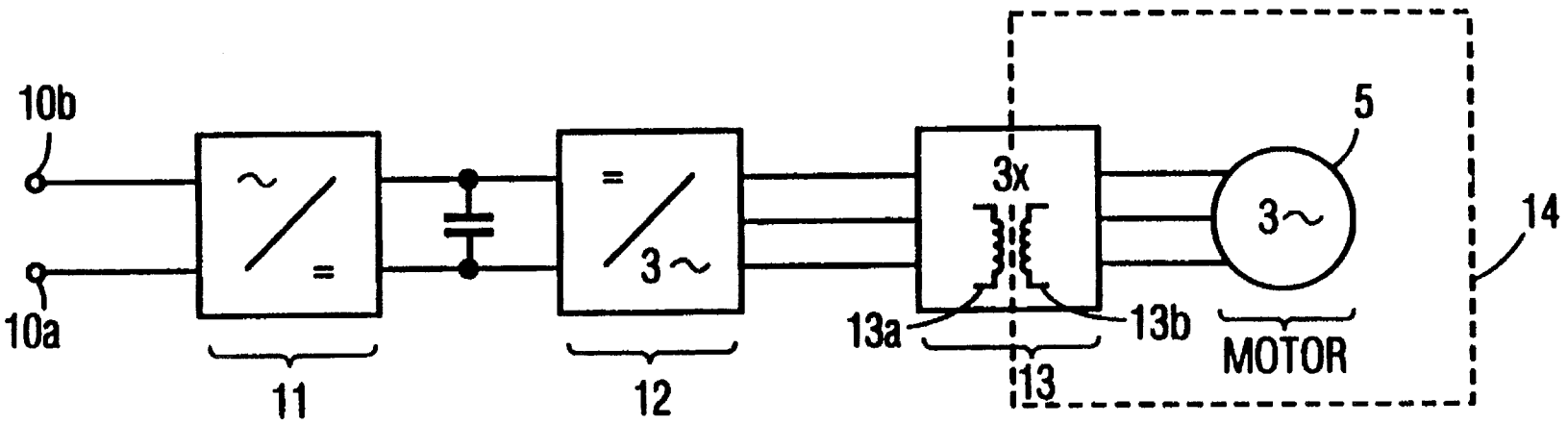
FIG. 2 shows the power supply of the drive motor via an isolating transformer arrangement.
Figure 3:
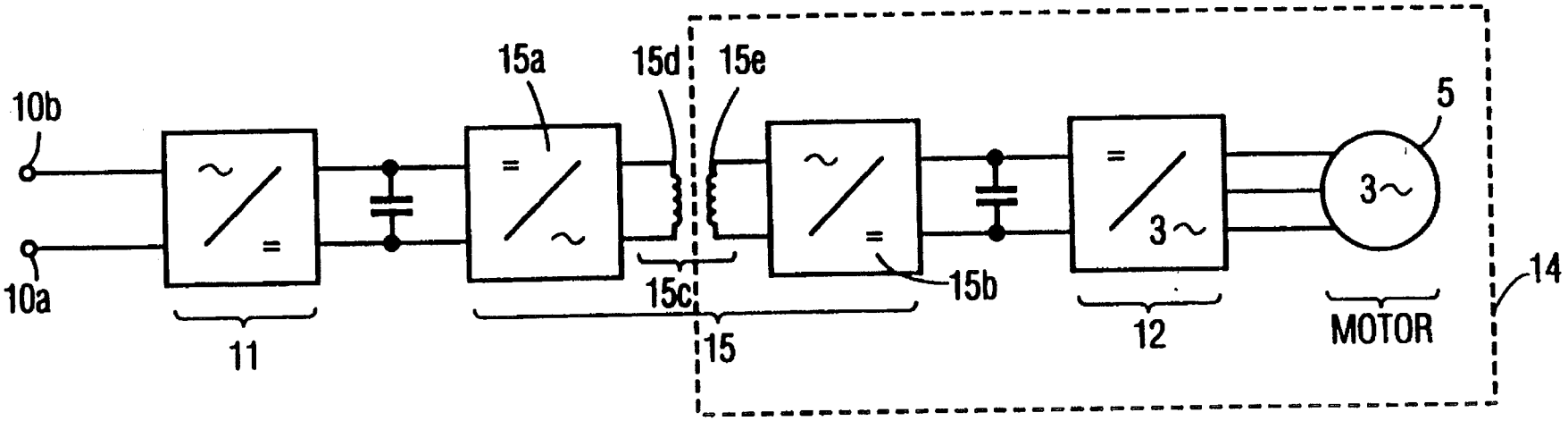
FIG. 3 shows the power supply of the drive motor via a potential-isolating DC/DC converter arrangement.

The motor is powered via potential-isolating transmission means as shown in FIG. 2 or 3. The potential-isolating transmission means shown in FIG. 2 comprise a rectifier 11 connected to mains terminals 10*a* and 10*b*, which rectifier is followed by an inverter 12 and an isolating transformer arrangement 13 having isolating transformer coils 13*a* and 13*b*. A box 14 indicates that the coil 13*b* and the motor 5 are situated in the high-voltage section of the X-ray tube. The AC section of the inverter, the coils 13*a* and 13*b* and the motor 5 are of the three-phase type.

FIG. 3 shows another example of the transmission means. In the same way as in FIG. 2 an alternating voltage is applied to the rectifier 11 via the terminals 10*a* and 10*b*, which rectifier converts the applied alternating current into a direct current and supplies it to a DC/DC converter 15. The DC/DC converter 15 has an inverter section 15*a*, a rectifier section 15*b* and a isolating transformer section 15*c*. The isolating transformer section 15*c* has two coils 15*d* and 15*e*. The rectifier section 15*b* supplies a direct voltage to an inverter 12, which converts the direct voltage applied to it into a three-phase AC system for powering the motor 5. FIG. 3 shows that the high-voltage section within the box 14 includes the coil 15*e* and the rectifier section 15*b* of the DC/DC converter 15, the inverter 12 and the motor 5.

I claim:

1. A rotary anode X-ray tube comprising:

(a) an enclosure comprising a first non-evacuated enclosure part and a second evacuated enclosure part, (b) a shaft journalled for rotation in the second enclosure part about an axis, (c) an anode mounted on one end of the shaft and within the second enclosure part, (d) a drive motor having a stator and a rotor for driving the anode, said stator being located within the first enclosure part, (e) means for applying to said anode, rotor and stator the same electrical potential, (f) said stator comprising a magnetic part and windings on the magnetic part, (g) said anode being axially spaced from the stator, (h) said rotor being within the second enclosure part and cylindrically configured as an external rotor and surrounding the stator and being connected to the shaft to rotate therewith, (i) said rotor comprising inner and outer concentric abutting cylindrical members of different materials, the inner cylindrical member comprising a material of high electrical conductivity, the outer cylindrical member comprising a material of high magnetic conductivity, (j) power transmission means for applying an electrical potential to the motor for driving same, said power transmission means comprising electrical potential isolating means for isolating the motor from the source of the electrical potential.

2. A rotary anode X-ray tube as claimed in claim 1, wherein the stator magnetic part comprises a lamination assembly of a certain length in the axial direction, and the rotor has a length in the axial direction greater than the length of the stator's lamination assembly and surrounds the latter.

3. A rotary anode X-ray tube as claimed in claim 1, wherein the rotor inner cylindrical member has a higher thermal expansion coefficient than that of the rotor outer cylindrical member.

4. A rotary anode X-ray tube as claimed in claim 3, wherein the rotor inner cylindrical member comprises copper, and the rotor outer cylindrical member comprises iron.

* * * * *